US006226945B1

(12) United States Patent
Henry et al.

(10) Patent No.: US 6,226,945 B1
(45) Date of Patent: May 8, 2001

(54) SAFETY MESH ROOF FACING SYSTEM

(75) Inventors: Mark J. Henry, Overland Park, KS (US); Timothy M. Pendley, Madera, CA (US)

(73) Assignee: Butler Manufacturing Company, Inc, Kansas City, MO (US)

( * ) Notice: Subject to any disclaimer, the term of this patent is extended or adjusted under 35 U.S.C. 154(b) by 0 days.

(21) Appl. No.: 09/238,019

(22) Filed: Jan. 26, 1999

(51) Int. Cl.[7] ..... E04B 7/00

(52) U.S. Cl. ..... 52/408; 52/96; 52/3; 52/676; 52/506.05

(58) Field of Search ..... 52/3, 96, 676, 52/506.05, 408

(56) References Cited

U.S. PATENT DOCUMENTS

| | | | |
|---|---|---|---|
| 545,301 | 8/1895 | Milliken . | |
| 619,769 | 2/1899 | Lilienthal . | |
| 3,506,746 | 4/1970 | Fontaine . | |
| 4,047,346 | 9/1977 | Alderman . | |
| 4,434,601 | 3/1984 | Zellmer . | |
| 4,557,092 | 12/1985 | Brueske . | |
| 5,119,612 | 6/1992 | Taylor et al. . | |
| 5,197,239 | 3/1993 | Glynn et al. . | |
| 5,201,152 | 4/1993 | Heffner . | |
| 5,251,415 | 10/1993 | Van Auken et al. . | |
| 5,406,764 | 4/1995 | Van Auken et al. . | |
| 6,088,992 * | 7/2000 | Nunley | 52/783.19 |

* cited by examiner

*Primary Examiner*—Beth A. Stephan
*Assistant Examiner*—Dennis L. Dorsey
(74) *Attorney, Agent, or Firm*—Shoemaker and Mattare, Ltd

(57) ABSTRACT

A roofing system designed to protect roof construction workers from falls includes a strong nonmetallic mesh placed over an array of purlins, and secured to the periphery of the roof by a series of metal straps which plastically deform individually under large loads to absorb energy.

6 Claims, 13 Drawing Sheets

FIG. 7
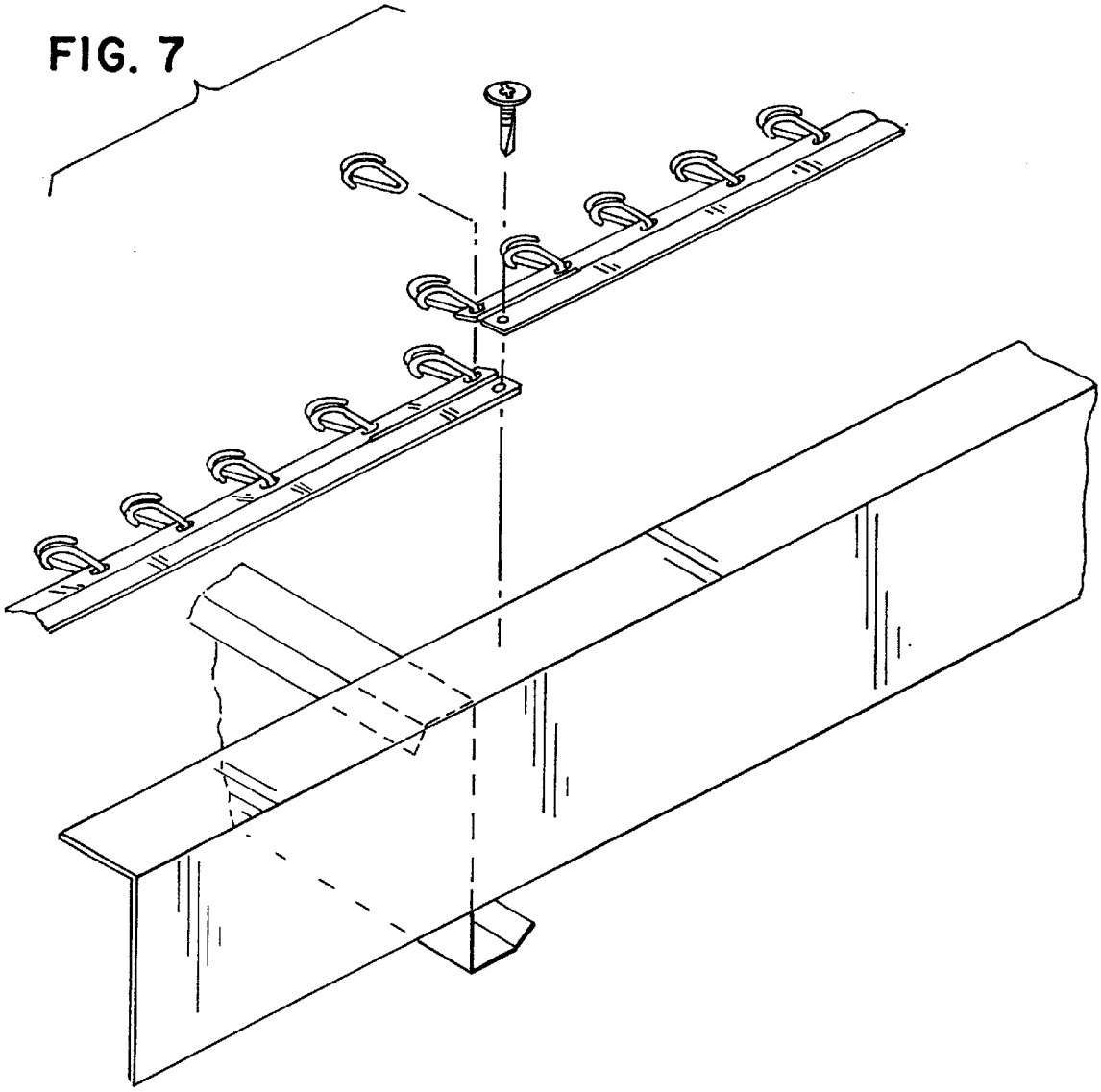
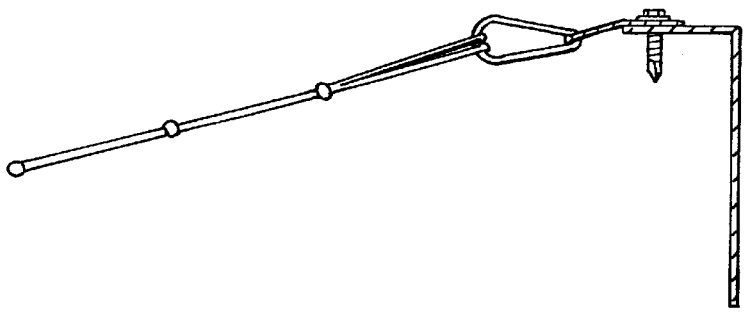
FIG. 8

SAFETY MESH ROOF FACING SYSTEM

BACKGROUND OF THE INVENTION

This invention relates to building construction, and particularly to a roof system for buildings, especially metal buildings with insulated roofs.

Expanded metal, metal screen, and other types of mesh have been proposed previously for use in constructing walls and ceilings of buildings. In some cases, as in U.S. Pat. No. 4,522,004, cementitious material or plaster is applied over the mesh. Mesh has also been used to support or retain insulating material, as in U.S. Pat. No. 2,148,281 and wire mesh reinforcement has been proposed, as in U.S. Pat. No. 4,047,346.

In U.S. Pat. No. 3,506,746, a net supported by poles serves as a support for receiving plaster, which hardens to form a structure in which doors and windows are subsequently cut. U.S. Pat. No. 545,301 describes a method of constructing an arched roof by applying concrete or cement to a corrugated wire mesh supported by structural beams.

U.S. Pat. No. 4,557,092 describes an insulating blanket having a strong scrim layer attached to its fiber barrier, to resist falling objects. It has been found difficult, however, to create joints of sufficient strength in such material to prevent heavy objects from falling through.

Finally, flexible materials have been used to support ceiling insulation in a dropped ceiling construction, as shown in U.S. Pat. No. 3,791,089.

None of the above patents adequately addresses the issue of worker safety, which is a particular object of this invention.

Butler Manufacturing's U.S. Pat. Nos. 5,251,415 and 5,406,764 describe roofing methods employing mesh laid over a roof prior to completion to catch dropped objects and to support insulation which is installed subsequently.

We are especially concerned with construction worker safety. Unfortunately, serious falling injuries occur from time to time during roof construction. It is therefore standard and required practice to provide safety netting or other material below roof installers to protect them and those below, and/or to require workers to be tied or tethered to the structure.

Tethers are only temporarily effective. When one neglects to apply a required tether, or while it is being moved, the workman and those below him are at risk. It would be better to have a restraint that could not be avoided, and did not require a positive act to be effective. Additionally, it would be preferable to use safety netting that would become part of the roof, to save the labor of removing the netting.

SUMMARY OF THE INVENTION

An object of the invention is to improve worker safety while constructing a roof.

The improvement comprises a nonmetallic mesh installed over and supported by the purlins, and which can be left in place while insulation, roof panels and the like are laid over it.

BRIEF DESCRIPTION OF THE DRAWINGS

In the accompanying drawings:

FIG. 7 is a view like FIG. 4, showing the connecting hardware along one gable of the roof;

FIG. 8 is an view like FIG. 5, at the gable;

DESCRIPTION OF THE PREFERRED EMBODIMENT

Figure 1:
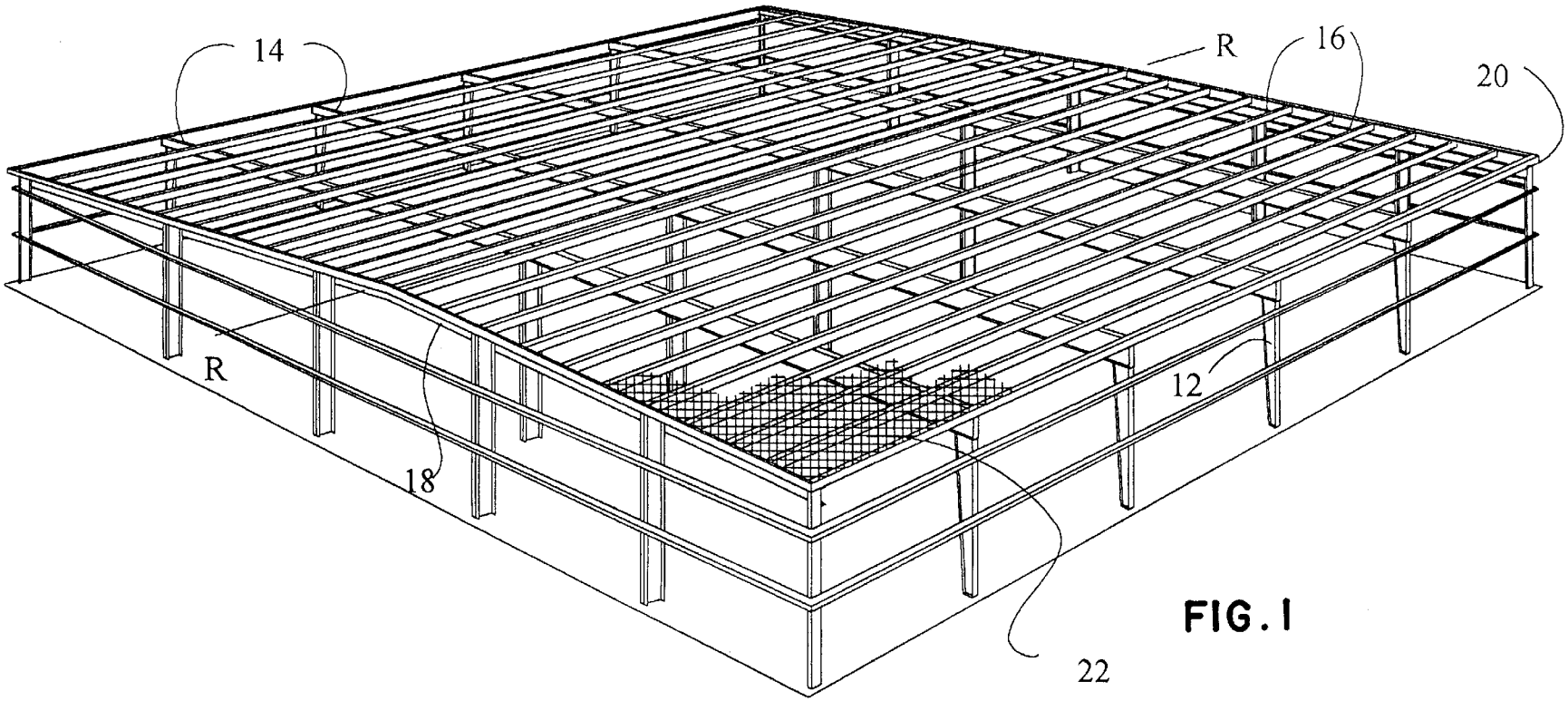
FIG. 1 is an isometric view of an uncompleted building.

The building shown in FIG. 1 has a frame composed of plural pairs of vertical structural members or columns 12, the upper ends of each pair of columns being interconnected by a structural beam 14 extending in a direction transverse to the roof ridge line R—R. The transverse beams support an array of parallel purlins 16, each orthogonal to the beams, that is, extending along the length of the building, parallel to the roof ridge line. The purlins are equally spaced, for example at five foot intervals. The purlins may be C- or Z-section members formed from sheet metal. Their exposed ends at either end of the building are capped by gable angles 18. Eave struts 20 are installed at the edges of the roof, each extending parallel to the purlins; the eave struts are preferably C-section members whose open sides face toward the center of the roof.

Figure 2:
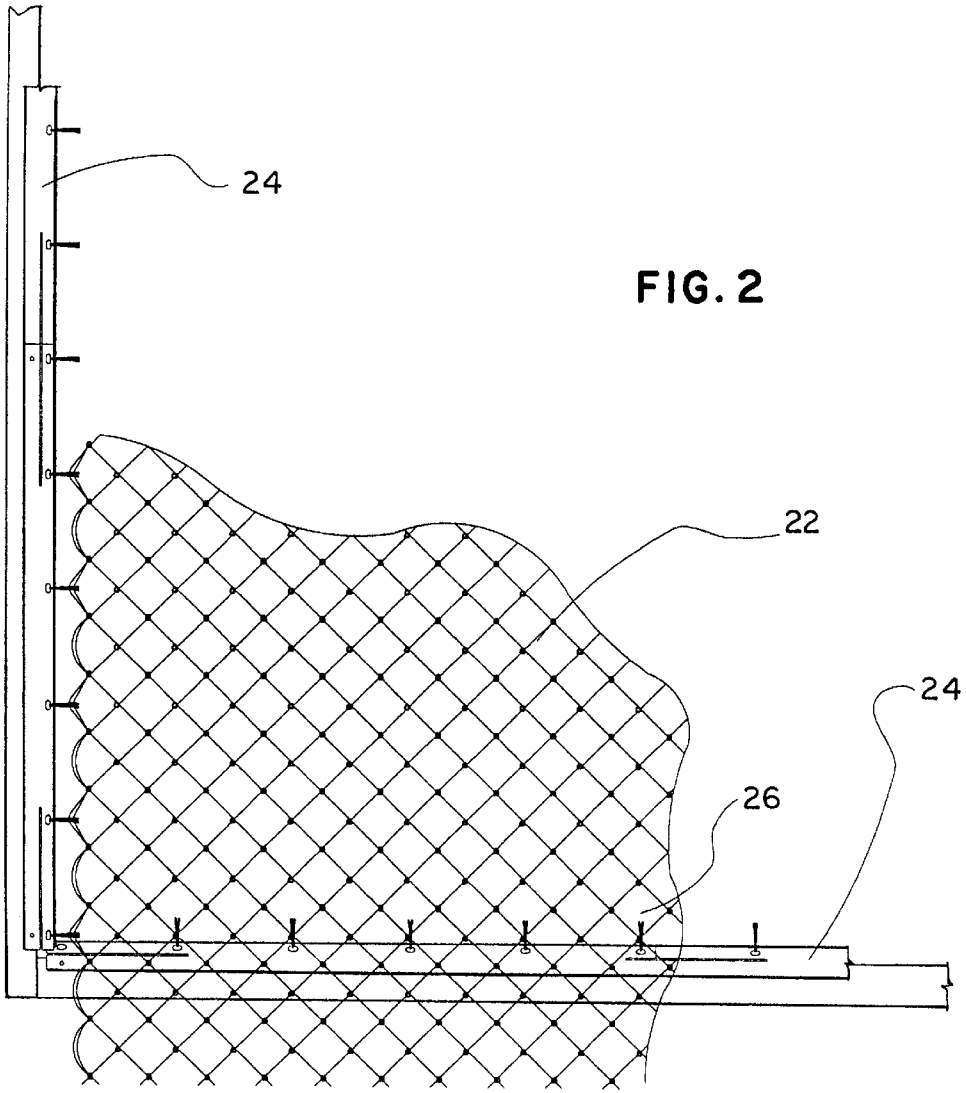
FIG. 2 is an enlarged view from above of one corner of the building, showing a portion of a mesh web and fasteners connecting the mesh to the substructure.

As FIG. 2 shows, a mesh material 22 is stretched across the roof, directly over the purlins, and attached to the substructure along the edges of the roof.

The preferred mesh material is a knotted nylon mesh forming a nominal 2¾"×2¾" grid. The mesh must have sufficient strength to break the fall of a typical worker and his tools working at the level of the purlins, midway between purlins. For added safety, we require the material to pass a dropping test with a 400 pound bag of sand dropped from a height of 42" above the top of the purlins. A mesh material weighing 1.8 ounces per square yard, and meeting the strength requirements of the preceding sentence, is available from Diamond Nets, Inc., Everson, Wash.

Figure 6:
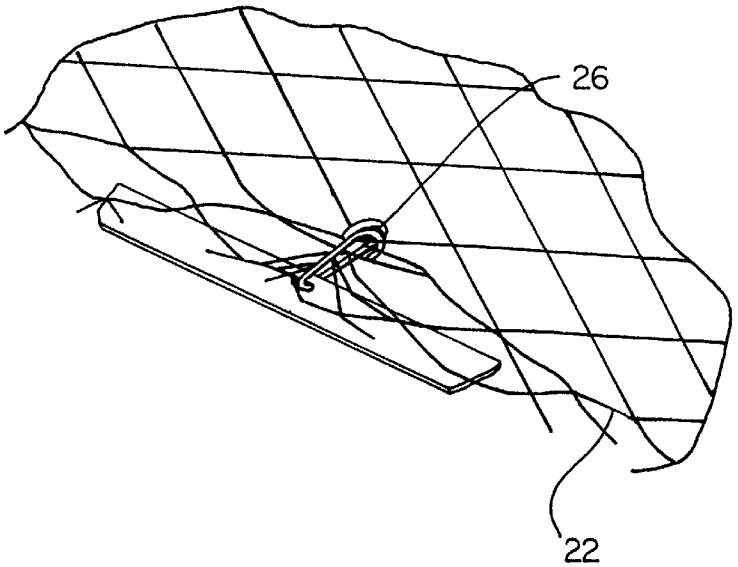
FIG. 6 illustrates one mesh connection point in detail.

FIG. 2 shows a corner of the building from above. Energy-absorbing steel straps 24 have been installed along the gable angles and eave struts, and the mesh is connected to these by ⅛" diameter spring wire clips 26 passing through elongated openings 28 provided in the straps at 7¾" intervals. A better view of one of the clips is in FIG. 6. The clips are designed to allow the mesh to be quickly and easily hooked into the wire clip but not to allow the mesh to escape once the wire clip is hooked. Additionally, the clip is designed so that when the mesh pulls against the wire clip, the mesh can only pull on a double-wire section of the clip, not on the single wire section. This reduces any potential tendency of the single wire to cut the mesh.

Figure 3:
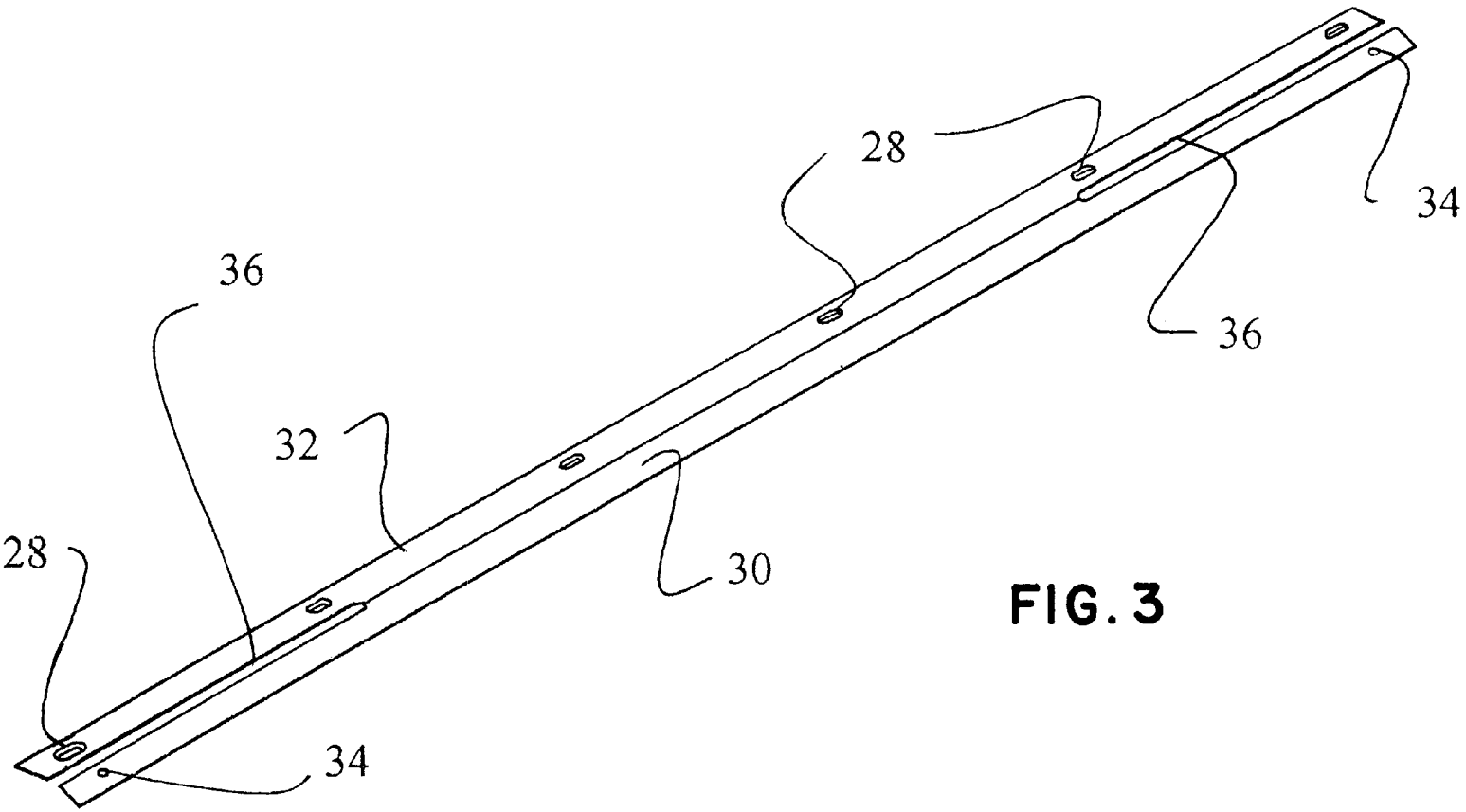
FIG. 3 is an isometric view of a connecting strap to which an edge of the mesh is attached.

FIG. 3 shows a preferred strap in detail. Made of 18-gauge galvanized steel, it is 40⅞" long and has a negative dihedral angle of twenty degrees between two wings 30,32 of unequal width. One of the wings 30 has two holes 34, one at either end; the other has the elongated openings 28 mentioned previously. Lengthwise 9½" long slots 36 at either end of the strap promote yielding of the strap under heavy loads, causing it to act as an energy absorber when, for example, a workman falls on the mesh near the roof edge. In such a case, both wings yield plastically, so that the strap comes to resemble the letter "X" or "K". Because the deformation is permanent, the straps affected must be replaced, once they have performed their energy-absorbing function. The event of deformation absorbs substantial energy right at the edge of the roof, thus protecting the selvedge from tearing at its attachment points to the substructure.

Loading tests were performed on sample straps to evaluate their strength. The strap was screwed to a fixture simulating a roof eave. Then force was applied to the free portions of the strap by pulling in a direction perpendicular to the length of the strap, in the plane of the strap. The strap was observed to deform elastically up to a its elastic limit; thereafter, at about 60 pounds per lineal foot, it deformed plastically with increasing resistance up to the point of failure. The failure mode was tensile failure of the strap at the screw holes. The ultimate strength of the strap exceeds that of the mesh so that, in actual use, the strap will not fail.

Figure 4:
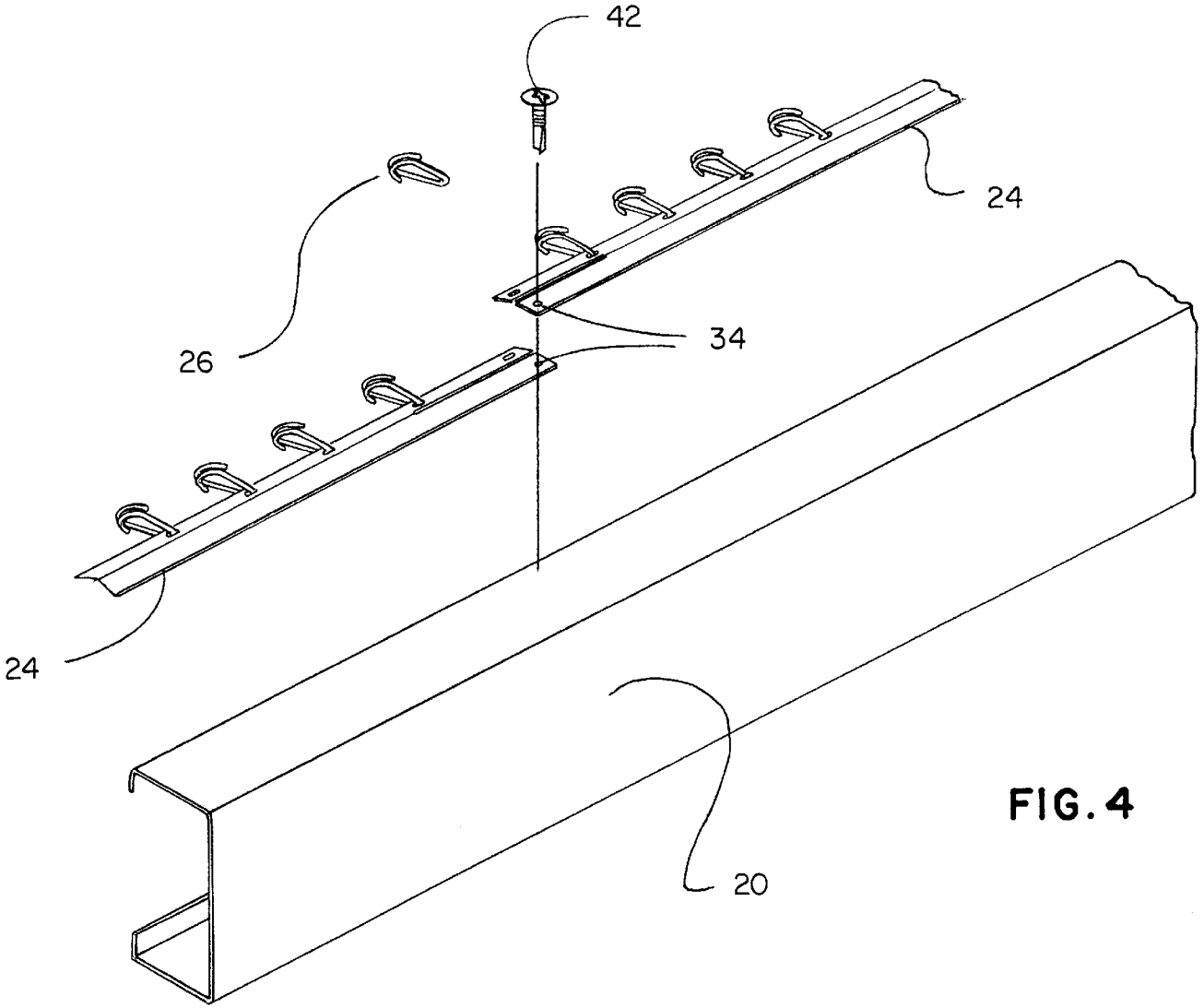
FIG. 4 is an exploded isometric view showing a structural element, two connecting straps, and associated hardware at one eave of the roof.
Figure 5:
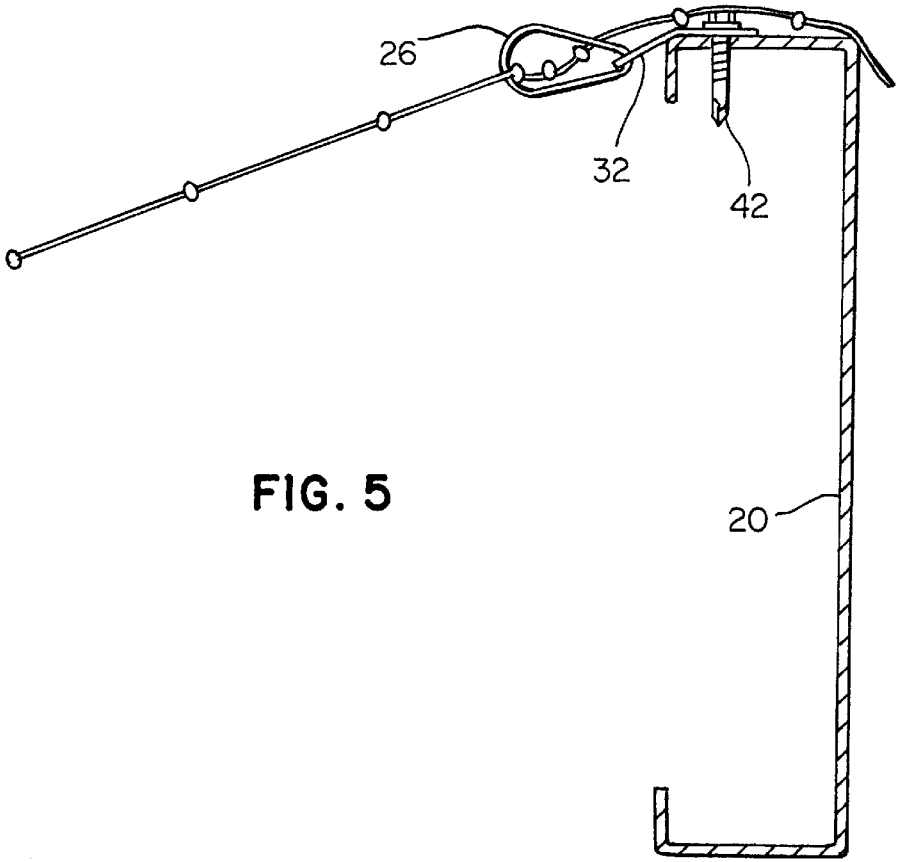
FIG. 5 is a sectional view, on a vertical plane, of the mesh and connecting hardware shown along the eave of the roof in FIG. 2.

FIG. 4 shows the eave strut 20 to which two straps 24 are about to be attached by means of self-drilling screws 42 inserted through the holes 34 of the overlapped straps. Clips 26 have been pre-installed in the openings 28 to speed mesh installation. In FIG. 5, one sees the mesh now secured to the eave struts. It is apparent that the dihedral angle causes the inner wing 32 to angle downward, more or less at the angle of the mesh, when it is loaded.

The installation along a gable is very similar (see FIGS. 7 and 8).

Figure 9:
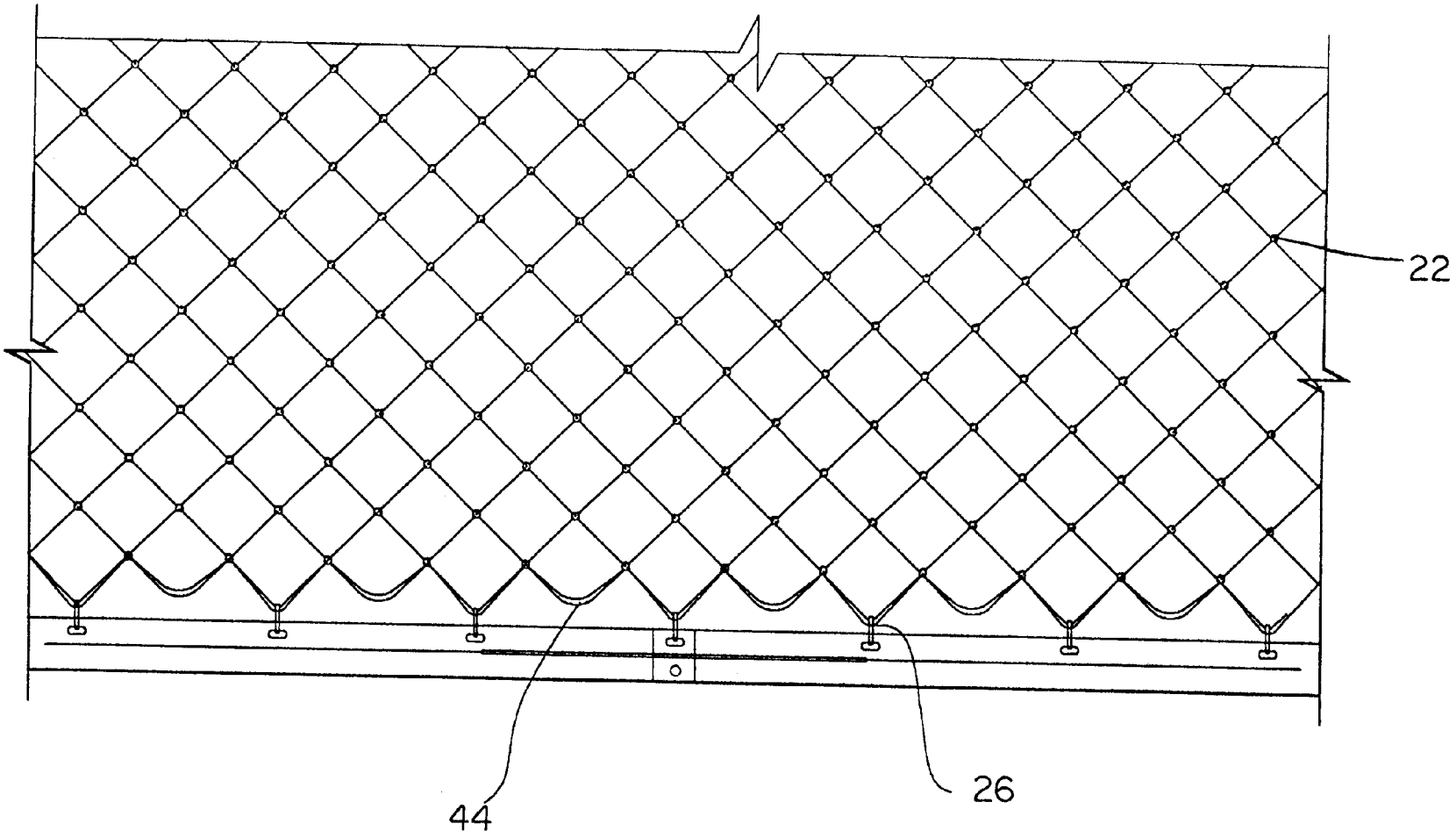
FIG. 9 is a plan view of the mesh installation along a gable.
Figure 10B:
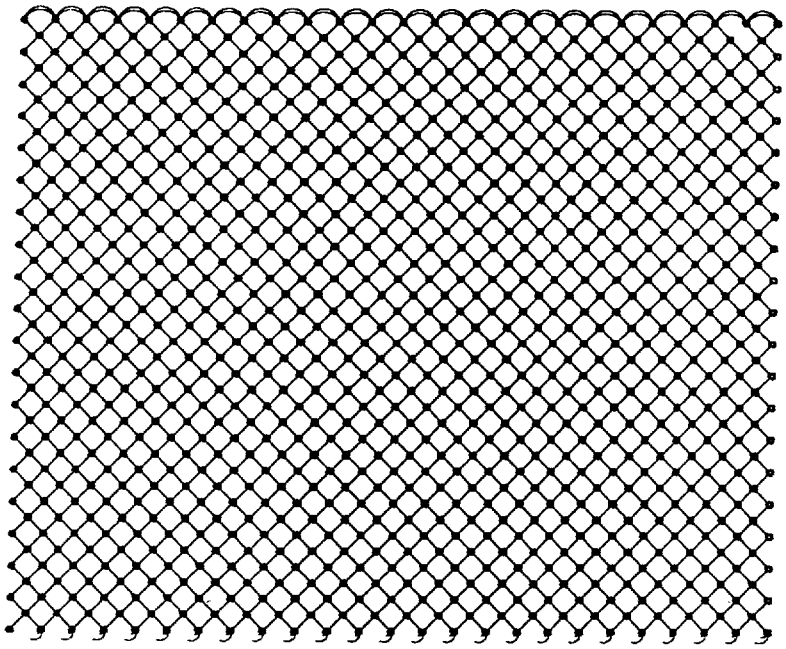
FIGS. 10*a* and 10*b* show two varieties of mesh web, the one in FIG. 10*a* having a heavier gauge along one edge.
Figure 10A:
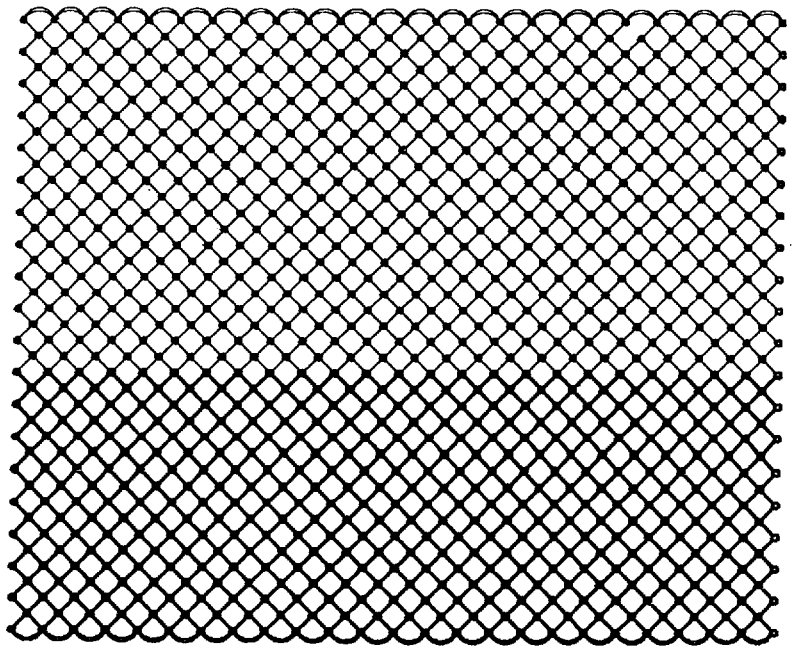

FIG. 9 shows the reinforced selvedge 44. Two versions of the mesh, one reinforced along one edge, are shown in FIGS. 10*a* and 10*b*. The reinforcement would be placed along a gable angle, at the edge of the roof, where the chance of failure is the greatest. Toward the middle of the roof, the mesh has more give and thus does not have to be as strong.

Standard building bays (the distance between beams) vary in width. The mesh is fabricated to order, to match the bay dimensions. One piece of mesh extends from eave to eave and may cover one or two bays. The maximum mesh width is sixty-five feet.

Figure 11A:
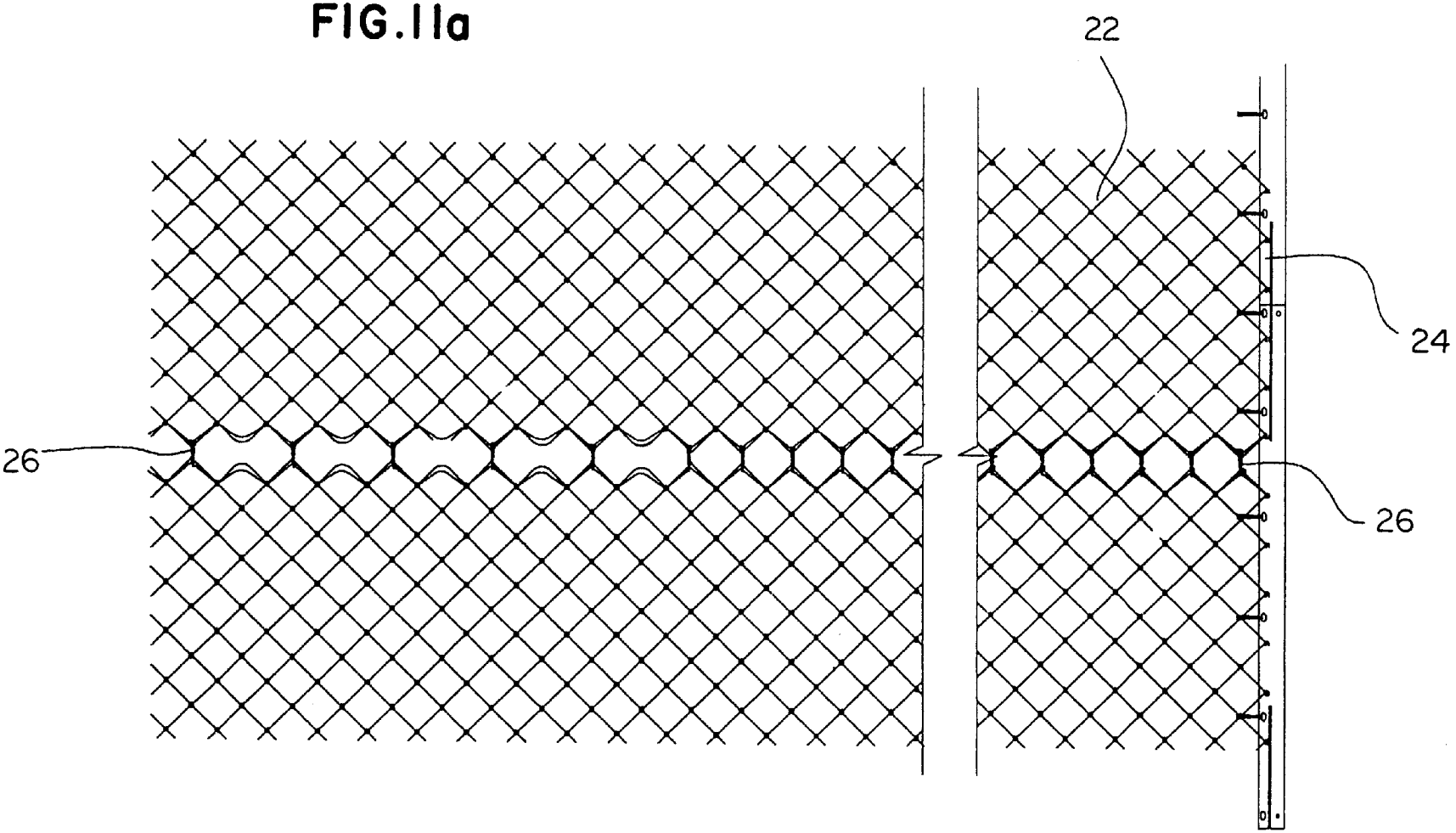
FIGS. 11*a* and 11*b* are plan and side views of a splice between two parallel mesh webs.
Figure 11B:
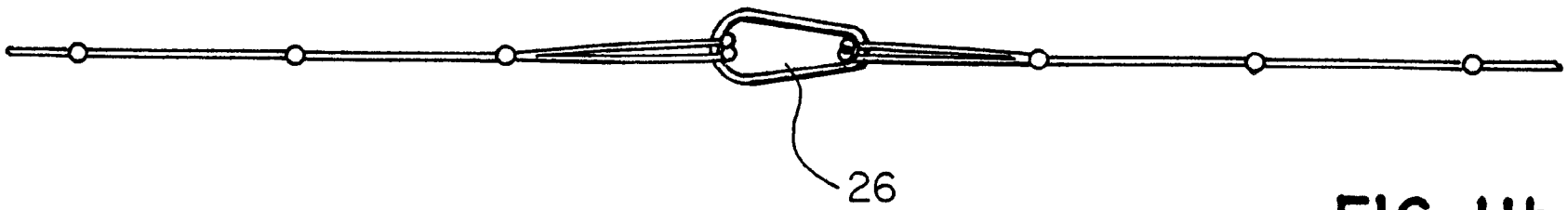

Adjacent widths of mesh are joined by means of clips 26, as shown in FIGS. 11*a* and 11*b*, passed through the selvedge of width. Mesh-to-mesh splices are located above the primary frames.

Figure 12:
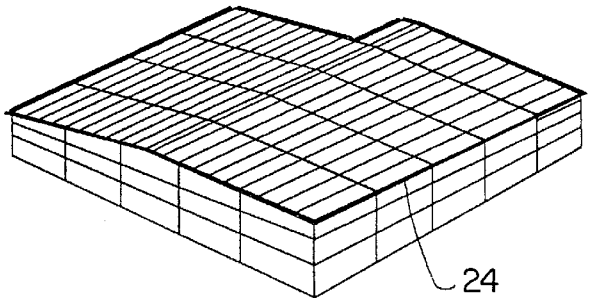

FIG. 12 shows the building with heavy lines around the perimeter representing a series of straps 24 which has been attached to the entire perimeter as described above.

Figure 13:
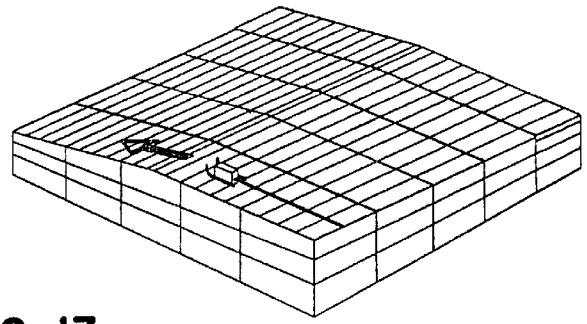
FIGS. 12–15 show steps of installing mesh upon the substructure.

A packaged bundle of the mesh is placed at the edge of the roof framing. One end of the mesh is temporarily attached to the eave strut, and then the bundle is pulled across the roof purlins, allowing the mesh to string out behind the bundle (FIG. 13).

Figure 14:
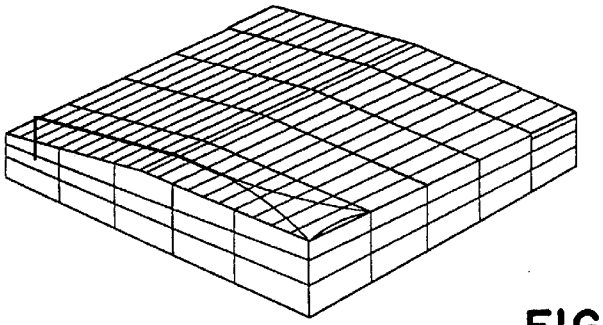
Figure 16:
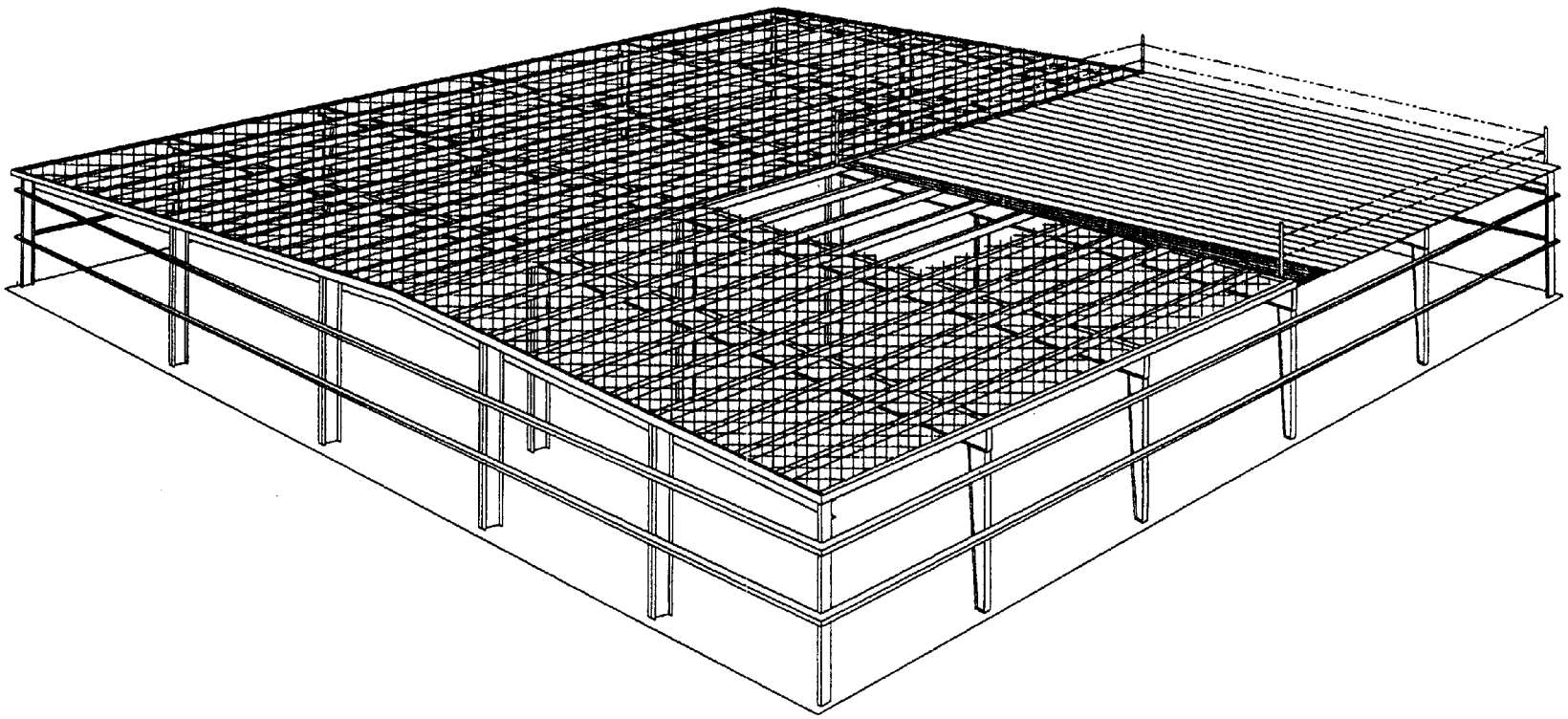
FIG. 16 shows the substructure covered with mesh, and roof panels laid over the mesh at one corner.

At the far eave, the bundle is left on top of the roof framing while the mesh at the starting end is stretched across the width of the bay. The mesh is attached first to the wire clips along the eave strut and then along the gable (FIG. 14).

Figure 15:
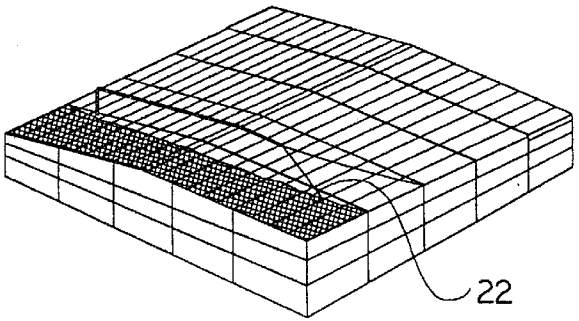

The mesh at the far eave is then attached. The next bay of mesh is then strung out over the roof purlins in a similar manner. After it is attached along the eave, the second mesh is connected edgewise to the first mesh (FIG. 15). This process is continued the length of the building.

As a precaution, workers should be tethered to the structure while applying the mesh. Care must be taken not to tear the mesh during installation; an observer should look for and report any rips he discovers. The mesh is strong enough to withstand foot traffic, but such traffic should be limited to avoid damaging the mesh.

Figure 17:
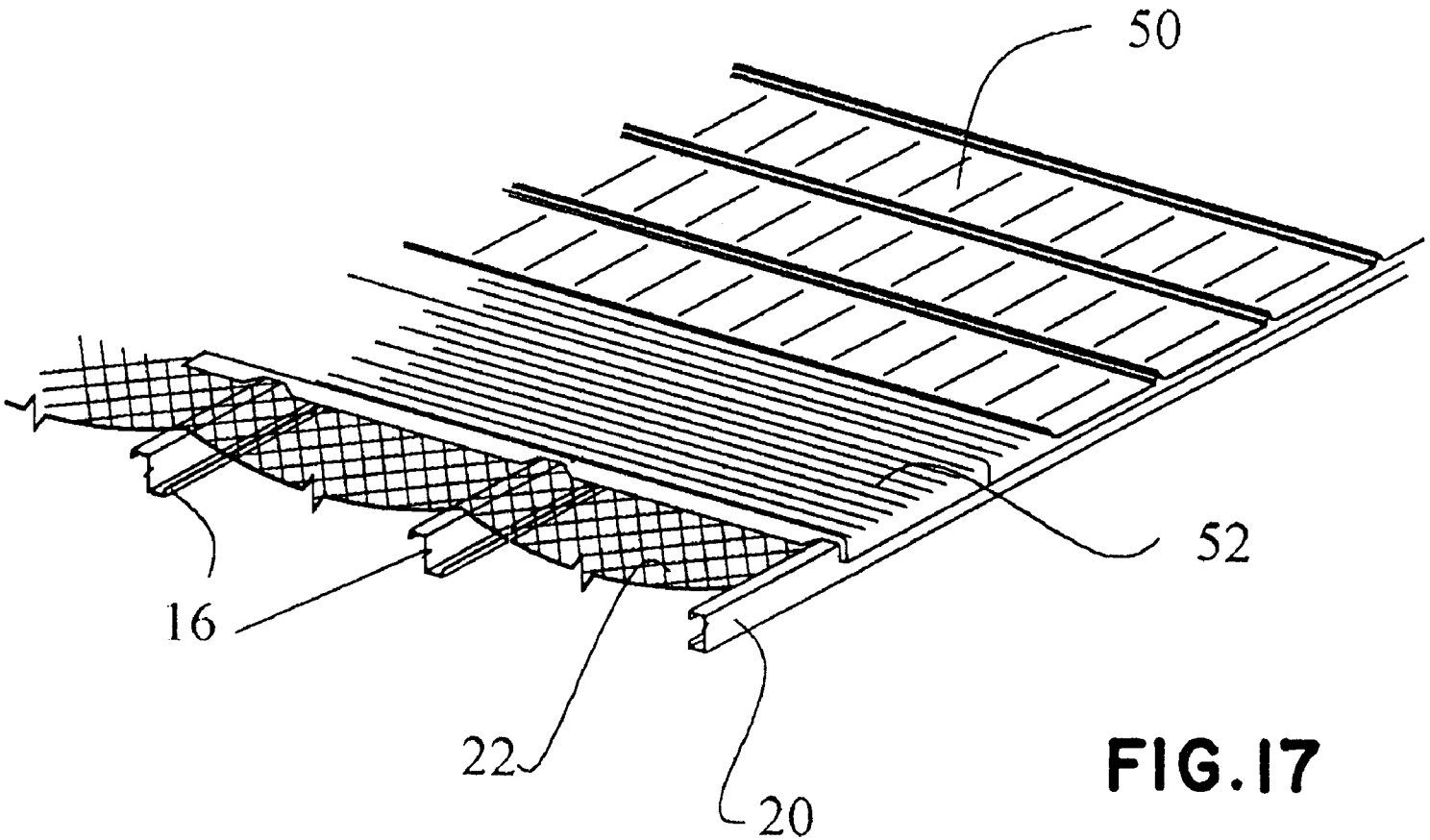
FIG. 17 is an enlarged view showing insulation laid upon the mesh, then covered with roof panels.

Once the entire roof has been covered with mesh and insulation, metal roof panels 50 are laid over both (and this should be done within sixty days of the mesh installation, since prolonged weathering can have a deleterious effect). During this phase, the strong mesh provides protection against falling, and from larger dropped objects. The mesh provides excellent support for the insulation and enhances the appearance of the insulation, as one can see in FIG. 17.

The roof panels are secured to the purlins or joists by screws or specially designed panel clips.

With the present invention, added worker safety is obtained at minimal effort, since the mesh need not be removed; it remains in position for the life of the roof.

The foregoing description illustrates only one mode—the best now contemplated—of practicing the invention. Many changes can be made to details without departing from the gist of the invention claimed below. For example, the metal purlins described above could be any functional equivalent, including wooden joists, or truss-type members such as Butler Manufacturing's "Delta Joist".

Inasmuch as the invention is subject to these and other modifications and variations, it is intended that the foregoing description and the accompanying drawings shall be interpreted as illustrative of only one form of the invention, whose scope is to be measured by the following claims.

We claim:

1. In a roof comprising a plurality of transverse beams, a plurality of spaced, parallel purlins each extending orthogonal to the beams, peripheral members defining edges of the roof, and a nonmetallic safety mesh extending over and supported by said purlins, the improvement comprising a plurality of connectors for joining an edge of the mesh to the peripheral members, each of said connectors being designed to undergo substantial plastic deformation without failing when the connector experiences high loading from the mesh, as when a worker falls onto the mesh, thus inhibiting failure of the mesh wherein each of said connectors is a metal strap including a pair of lateral wings, each of said wings having holes for receiving fasteners, said mesh being connected to one of said wings, and the other of said wings being connected to an edge of the roof, at least one of said wings being capable of yielding plastically under load.

2. The invention of claim 1, further comprising gable angles extending perpendicular to the purlins at either end of the building, the mesh being secured to the gable angles along said roof ends.

3. The invention of claim 1, wherein the roof has eave struts at each edge of the roof, extending parallel to the purlins, the mesh has reinforced leading and trailing ends and is installed with said leading and trailing ends along respective ones of said eave struts, and further comprising means for clamping each of said leading and trailing ends to a respective eave strut.

4. The invention of claim 1, wherein the mesh has sufficient strength to arrest the fall of a four hundred pound weight, dropped from a height of forty-two inches above the mesh at a location between purlins.

5. The invention of claim 1, further comprising slots at either end of said strap separating end portions of said wings from one another, whereby at least one of the wings can bend plastically to absorb energy under sufficient loading forces from said mesh.

6. The invention of claim 1, wherein the strap is bent widthwise between said wing portions, so that there is a negative dihedral angle of about 20° between the wings.

* * * * *